United States Patent [19]

Barbee

[11] 4,247,100

[45] Jan. 27, 1981

[54] BOWLING BALL TRACKING DEVICE

[76] Inventor: Ronald D. Barbee, 1077 SW. 3rd Ave., Ontario, Oreg. 97919

[21] Appl. No.: 638,127

[22] Filed: Apr. 12, 1976

[51] Int. Cl.[3] ..... A63D 5/04

[52] U.S. Cl. ..... 273/54 D

[58] Field of Search ..... 273/41, 54 R, 54 D, 273/102.2 B; 35/29 F

[56] References Cited

U.S. PATENT DOCUMENTS

| | | | |
|---|---|---|---|
| 2,968,804 | 1/1961 | Buffington | 273/54 R UX |
| 3,009,268 | 11/1961 | George | 273/54 D UX |
| 3,051,485 | 8/1962 | Heilbrun | 273/54 D |
| 3,252,705 | 5/1966 | Cornberg | 273/54 D |
| 3,401,937 | 9/1968 | Rockwood et al. | 273/102.2 B |
| 3,595,574 | 7/1971 | Saffer | 273/41 |

*Primary Examiner*—Anton O. Oechsle
*Attorney, Agent, or Firm*—Francis Swanson

[57] ABSTRACT

The bowling ball tracking device of this invention employs a focused light source superimposed over the spotting portion of a bowling alley; and a photoelectric switch circuit having a plurality of photoelectric cells responsive to light from the light sources disposed in transverse rows at intervals along the bowling alley, and controlling lamps on a display. The illuminated display may also include conventional displays showing location of standing pins. The present device may also be adapted to include multiple point references wherein several photoelectric observations are displayed on the aforesaid display map.

2 Claims, 3 Drawing Figures

BOWLING BALL TRACKING DEVICE

FIELD OF THE INVENTION

The present invention relates to bowling, and more particularly to accessories therefor.

BACKGROUND OF THE INVENTION

"Spot Bowling" is the practice of aiming the ball at specific markings provided in a bowling alley in order to accurately and reliably strike pins. It is a well-known problem that beginning and junior bowlers learning to "spot bowl" may lack sufficient confidence and concentration to be able to recall the path of the ball with respect to the spots. This may frustrate efforts to learn this recommended technique of bowling.

Accordingly, it is an object to the present invention to provide a bowling ball tracking device which may display the path of the ball with respect to conventionally known bowling alley spots.

It is a further object to this invention that the present device have an illuminated display which may be used in combination with spare pin indicating devices which are provided to show a most reliable ball attack with respect to pins left in a spare situation.

It is still another object to this invention that the present tracking device be of simple construction and may be adapted to substantially conventional bowling alley constructions.

These and other objects shall become apparent from the description following, it being understood that modifications may be made without affecting the teachings of the invention here set out.

SUMMARY OF THE INVENTION

The bowling ball tracking device of this invention employs a focused light source superimposed over the spotting portion of a bowling alley; and a photoelectric switch circuit having a plurality of photoelectric cells responsive to light from the light source being disposed in transverse rows at intervals along the bowling alley, and controlling lamps on a display. The illuminated display may may also include conventional displays showing location of standing pins. The present device may also be adapted to include multiple point references wherein several photoelectric observations are displayed on the aforesaid display map.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
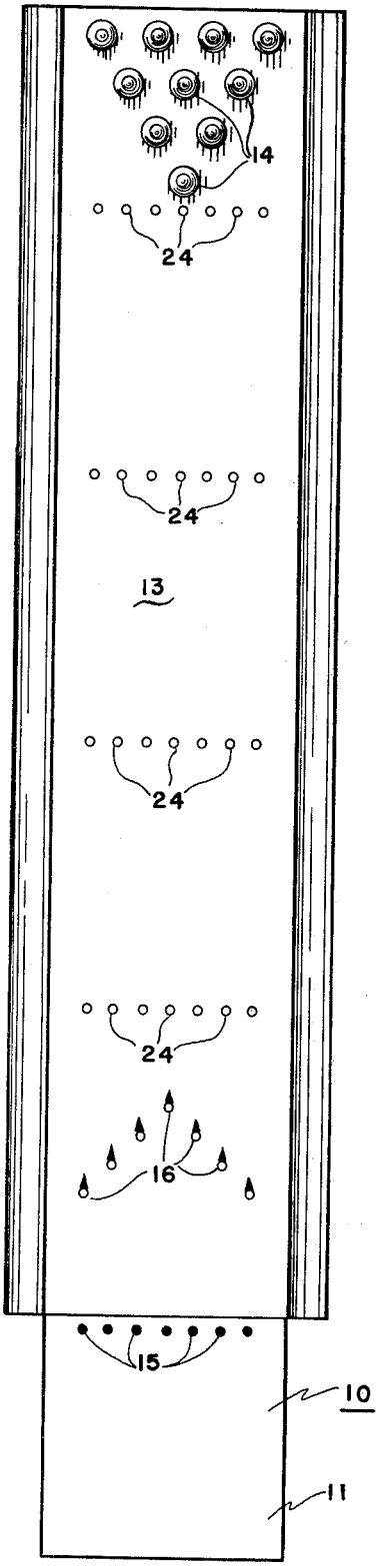
FIG. 1 is a top plan view of a bowling alley.

Referring now to the drawings and more particularly to the FIG. 1, the bowling ball tracking device of this invention is intended to be employed in a suitably adapted bowling alley 10 having the typical approach space 11, gutters 12 running parallelly along each side of a central lane 13. The lane 10 is to be employed with ten conventional pins juxtaposed in the usual way at the terminal end opposite the approach space 11 of the lane 13. The alley 10 is provided with a plurality of markers by which a bowler aims his ball at pins (a practice known as spot bowling). The aforesaid markings include a plurality circular spots inlaid into the forewardmost terminal end of the approach space 11, and an equal number of arrows disposed in an arrow-like pattern distally down the alley 13 from the spots 15. The spots 15 are disposed in a row which is transverse to the rectilinear centerline of the alley 10. The arrows, or points 16, are disposed in an arrow-like pattern which points 16 disposed centrally, are disposed forwardly with respect to more outboard points 16. As with the spots 15 the points 16 are inlaid into the surface of the alley 13. As shall be described hereinafter, each of the spots 15 and points 16 may be provided with a sensor of the present device.

Figure 2:
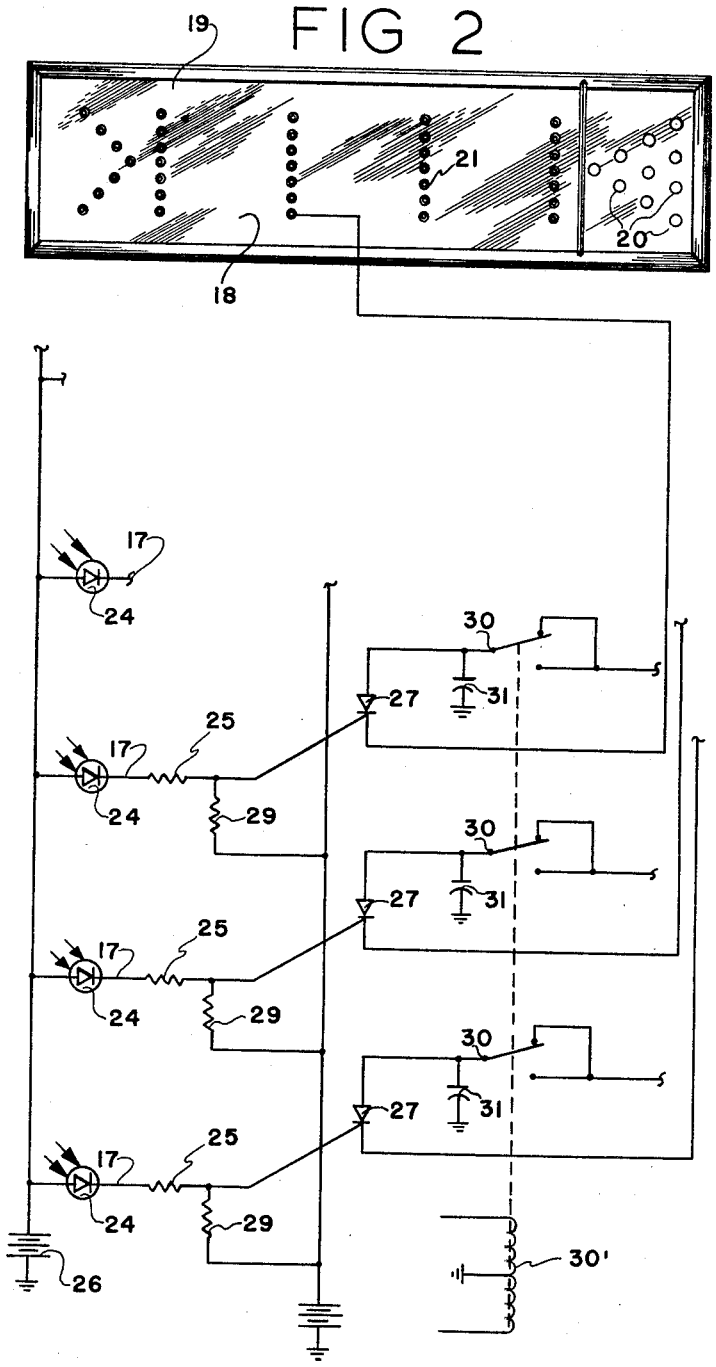
FIG. 2 is a schematic diagram of the electronic and display components of this invention.

Referring to the FIG. 2, each spot 16 is provided with a light responsive sensor-signaling circuit 17 which is integrated into the network of which the present device is comprised. The device 10 signals in response to the sensing circuits 17 to a display map 18 which includes a suitable graphic representing the graphical surface 19 which represents all parts of the lane 10 together with the pins 14. A plurality of indicators, such as lamps 21 are disposed in a surface at points corresponding to points on the lane 10 described hereinafter. The graphical portion 20 representing to the pins 14 may be coupled to pin-spotting sensors (not shown) sometimes provided in pin setting apparatus of the prior art.

Figure 3:
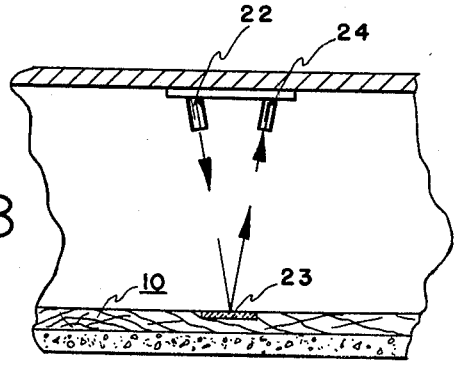
FIG. 3 is a fragmentary semi-diagramatic view of the light source and photoelectric cell employed in the device of this invention.

Referring to the FIG. 3, each light responsive sensor herein is mounted of a selected location with respect to the lane 13, and comprises a light force 22, mounted above each location over which a bowling ball is intended to pass, a light reflective plate 23 which is mounted in the surface of the lane 13, and a photocell 24 which is also mounted over the lane 10 to receive a ray of focused light emitted from the source 22 and reflected by the plate 23. Of course, the device 10 may also operate with an arrangement of either the source 22, or photocell 23, mounted in superimposed fashion, wherein one or the other component is mounted into the surface of the lane 10. Combinations of the components 22, 23, and 24 and mounted in rows transversely to the alley 10. In similar fashion, the spots 15 and 16 may be provided with combinations of the components 22, 23, and 24.

Referring again to the FIG. 2, each photocell 24 so mounted is intended to trigger the circuit 10 to illuminate the respectively controlled lamps 21. Each circuit 17 comprises in series a first direct current power source, the photocell 24, a resistor 25, and a silicon controlled switch 26. A second voltage source which is only fractionally as great as the first voltage source 26 is connected through a resistor 29 between the resistor 26, and the silicon controlled switch 27. A two-pull switch 30 is disposed between the silicon controlled switch 27, and the respective lamp 21 controlled by the circuit 17. The switches 30 controlling the display 18 are operated between their first and second operating positions from a single servo 30'. A capacitor and ground combination 31 is disposed between the switch 27 and the switch 30.

In operation, a line 11 defined when a circuit 17 is operated when a bowling ball passes between the ray provided by the light source 22, and the 24. The circuit 17 of the respective senser 24 is operable to both switch and maintain output to illuminate the respective lamp 21. The lamp 21 continues to be illuminated so long as the circuit 17 is maintained. When the switch 30 is changed from one operating position to another the silicon controlled switch 27 is deactivated and the circuit is in condition to receive the interruption provided by the bowling ball. A plurality of parallely connected circuits 17 provide a grid which may sense the path of a bowling ball. Thus, the track of a bowling ball is shown on the display 18 by a plurality of lamps 21 which have had their sensors 24 interrupted by the bowling ball passing between the source 22 and the sensor 24.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A bowling ball tracking device in combination with a conventional bowling lane having a lane approach space at one end and a bowling pin receiving space at the opposite end comprising:

a plurality of reflective spots embedded in the surface of the lane;

a source of light positioned above each spot, the light source focused on the spot;

a photo-electric cell positioned above each spot, the cell aligned relative to the spot so as to receive light reflected from the spot by the light source;

a visual display representative of the lane operatively connected to the lane;

an indicator lamp on the display operatively connected to each of the photo-electric cells above the reflective spots through a plurality of circuits connected in parallel, each circuit comprising, in series, the photo-electric cell associated with the lamp to be activated, a first direct current source, a silicon controlled switch having connection through a resistor to the photo-electric cell, the cell and silicon controlled switch being connected to a second direct current source, the second source being of fractional intensity of the first direct current source, the anode portion of the silicon controlled switch being connected to a mechanical switch, and the cathode portion of the silicon controlled switch being connected to the respective lamp to be activated in the display;

the circuit operative to activate the lamp in response to interruption of the reflective light from the spot associated with the photo-electric cell and the lamp.

2. A bowling ball tracking device in combination with a conventional bowling lane having a lane approach space at one end and a bowling pin receiving space at the opposite end comprising:

a first array of light reflector plates embedded in the surface of the approach space of the lane transverse to the longitudinal centerline of the lane;

a second array of light reflective plates embedded in the surface of the lane in an arrow-like pattern relative to the longitudinal centerline of the lane;

a third array of light reflecting plates comprising at least two rows of plates transverse to the longitudinal centerline of the lane toward the terminal end of the lane relative to the first and second array;

a light source positioned above each plate in each array, the light source focused on each plate;

a photo-electric cell positioned above each reflective plate and aligned so as to receive light from the light source reflected from the plate;

a visual display representing the lane operatively connected to the photo-electric cells, the display comprising a plurality of indicator lamps, each lamp corresponding to a single photo-electric cell associated with a single plate in the arrays;

a plurality of circuits connected in parallel interposed between the cells and the lamps, each circuit being operative to activate a lamp in the display associated with that lamp's photo-cell, in response to interruption of light reflected from the plate associated with the photo-cell, each circuit including, in series, the photo-cell associated with the lamp to be activated, a first direct current source, a silicon controlled switch having connection through a resistor to the photo-electric cell, the photo-electric cell and the silicon controlled switch being connected to a second direct current source, the second source being of fractional intensity of the first direct current source, the anode portion of the silicon controlled switch being connected to a mechanical switch, and the cathode portion of the silicon controlled switch being connected to the lamp to be activated in the display;

the mechanical switch in the circuit being further connected to a servo which provides means for actuating all switches in each cell-lamp circuit.

* * * * *